US009103148B2

(12) United States Patent
Wei

(10) Patent No.: US 9,103,148 B2
(45) Date of Patent: Aug. 11, 2015

(54) SHOWER DOOR ASSEMBLY

(71) Applicant: FOSHAN IDEAL CO., LTD., Foshan, Guangdong (CN)

(72) Inventor: Wuxiang Wei, Guangdong (CN)

(73) Assignee: Foshan Ideal Co., Ltd., Guangdong (CN)

( * ) Notice: Subject to any disclaimer, the term of this patent is extended or adjusted under 35 U.S.C. 154(b) by 0 days.

(21) Appl. No.: 13/798,187

(22) Filed: Mar. 13, 2013

(65) Prior Publication Data

US 2014/0115968 A1 May 1, 2014

(30) Foreign Application Priority Data

Nov. 1, 2012 (CN) ..... 2012 2 0570352 U

(51) Int. Cl.
*E05D 13/00* (2006.01)
*E05D 15/06* (2006.01)
*E05F 11/54* (2006.01)

(52) U.S. Cl.
CPC ..... *E05D 13/00* (2013.01); *E05D 15/063* (2013.01); *E05D 15/0665* (2013.01); *E05F 11/54* (2013.01); *E05Y 2900/114* (2013.01)

(58) Field of Classification Search
CPC ... E05D 13/00; E05D 15/063; E05D 15/0665; E05F 11/54; E05Y 2900/114
USPC ..... 49/409, 410, 411, 425; 16/91, 97, 98, 16/105–107; 4/557, 607
See application file for complete search history.

(56) References Cited

U.S. PATENT DOCUMENTS

| | | | | | |
|---|---|---|---|---|---|
| 3,384,998 | A | * | 5/1968 | Abramson | 49/411 |
| 4,014,377 | A | * | 3/1977 | Kochanowski | 160/186 |
| 4,014,378 | A | * | 3/1977 | Kochanowski | 160/186 |
| 4,256,164 | A | * | 3/1981 | Agcaoili | 160/186 |
| 4,399,636 | A | * | 8/1983 | Blackwell | 49/469 |
| 4,785,485 | A | * | 11/1988 | Etesam | 4/557 |
| 5,852,837 | A | * | 12/1998 | Husting | 4/607 |

* cited by examiner

*Primary Examiner* — Katherine Mitchell
*Assistant Examiner* — Catherine A Kelly
(74) *Attorney, Agent, or Firm* — Nixon Peabody LLP; Jeffrey L. Costellia

(57) ABSTRACT

A shower door assembly is disclosed comprising a top frame and a bottom frame; a first movable glass door having at least two first roller units at a top end of the first movable glass door and at least two second roller units at a bottom end of the first movable glass door; and a second movable glass door having at least two third roller units at a top end of the second movable glass door and at least two fourth roller units at a bottom end of the second movable glass door. The first and third roller units are slidably engaged with the top frame, and the second and fourth roller units are slidably engaged with the bottom frame. At least one of the first roller units is located between the third roller units and pressed by a first pressing device provided on the third roller units, and as a result at least one of the second roller units is located between the fourth roller units and pressed by a second pressing device provided on the fourth roller units.

11 Claims, 3 Drawing Sheets

SHOWER DOOR ASSEMBLY

CROSS-REFERENCE TO RELATED APPLICATIONS

The present application claims the benefit of Chinese utility model application No. 2012205703527 filed on 1 Nov. 2012, the disclosure of which is incorporated herein by reference.

FIELD OF THE INVENTION

The present invention relates to a shower door assembly and, in particular, to a shower door assembly having two jointly movable doors.

BACKGROUND OF THE INVENTION

Conventional shower doors have glass doors sliding on a rail with the aid of guiding means consisted of pulley wheels and connecting means for connecting the pulley wheels to the glass doors. The pulley wheels are extended into the rail so as to be able to roll along the rail such that the glass doors are slidable. When there are two panels of movable glass door, the movement of the one of the two panels is actuated by collision with the other. The collision between the two doors makes noise and shock which is undesirable. Alternatively, the movements of the two panels are synchronized through a synchronization means. However, the synchronization often fails due to the failure of the connection between the synchronization means and the wheels.

SUMMARY OF THE INVENTION

An object of the invention is to provide a shower door assembly that has simple structure and is convenient to operate.

To achieve the object, a shower door assembly is provided comprising a top frame and a bottom frame; a first movable glass door having at least two first roller units at a top end of the first movable glass door and at least two second roller units at a bottom end of the first movable glass door; a second movable glass door having at least two third roller units at a top end of the second movable glass door and at least two fourth roller units at a bottom end of the second movable glass door; wherein the first and third roller units are slidably engaged with the top frame, and the second and fourth roller units are slidably engaged with the bottom frame; wherein at least one of the first roller units is located between the third roller units and pressed by a first pressing device provided on the third roller units, and as a result at least one of the second roller units is located between the fourth roller units and pressed by a second pressing device provided on the fourth roller units.

In one embodiment, the first movable glass door is connected with the first and second roller units through a first fixing frame. The second movable glass door is connected with the third and fourth roller units through a second fixing frame.

In one embodiment, each of the first and second roller units comprises a roller seat connectable to the top/bottom frame, a roller bracket having a wheel and receivable in the roller seat, and a first pressing block connected with the roller bracket and able to press the roller bracket to move. The wheel is slidable within a rail of the top/bottom frame.

In one embodiment, a first elastic member is provided between the roller bracket and the roller seat. When the roller bracket is pressed by the first pressing block, the elastic member is compressed. On the other hand, when no force is applied on the roller bracket by the first pressing block, the elastic member is in physical state.

In another embodiment, each of the third and fourth roller units has substantively similar structure as the first and second ones, comprising a roller seat connectable to the top/bottom frame, a roller bracket having a wheel and receivable in the roller seat, and a second pressing block connected with the roller bracket and able to press the roller bracket to move. The wheel is slidable within a rail of the top/bottom frame. The difference exists in that the third and fourth pulley further comprises a fixing plug on the roller seat for engaging with the pressing device.

In one embodiment, a second elastic member is provided between the roller bracket and the roller seat of each of the third/fourth roller units. When the roller bracket is pressed by the second pressing block, the second elastic member is compressed. On the other hand, when no force is applied on the roller bracket by the second pressing block, the elastic member is in physical state. In one embodiment, the first and/or second elastic member is a spring.

In one embodiment, each of the first and second pressing device comprises a pressing bar having a groove. The pressing bar is connected with the fixing plug of the third/fourth pulley. In the groove, an elongate rubber is provided. The elongate rubber is in contact with the pulley wheels of the at least one of the first/second roller units located between the third/fourth roller units.

By the present invention, when one of the first and second movable glass door is moved, the other will be jointly moved because when for example the second movable door is moved, the elongate rubber will apply a friction force onto the pulley wheels of the roller units of the first movable glass door to drive the latter to roll along the rails of the top/bottom frames, such that the first glass door is actuated to move during the movement of the second glass door. In addition, because the first and second roller units as well as the third and fourth roller units have same structures, they are replaceable with each other. When it is desired, the first and second roller units can be mounted to the second glass door, and the third and fourth roller units can be mounted to the first glass door, such that the shower door is closed in an opposite direction.

BRIEF DESCRIPTION OF THE DRAWINGS

Further advantages and details of the present invention emerge from the example embodiments described below, which do not limit the invention in any way, and from the drawings, in which.

Elements that are irrelevant to the spirit of the present invention are omitted for clarity.

DETAILED DESCRIPTION OF THE INVENTION

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" include any and all combinations of one or more of the associated listed items. It will be further understood that the terms "comprises" "comprising" "includes" and/or "including" when used herein, specify the presence of stated features, integers, steps, operations, elements, and/or components, but do not preclude the presence or addition of one or more other features, integers, steps, operations, elements, components, and/or groups thereof.

Figure 1:
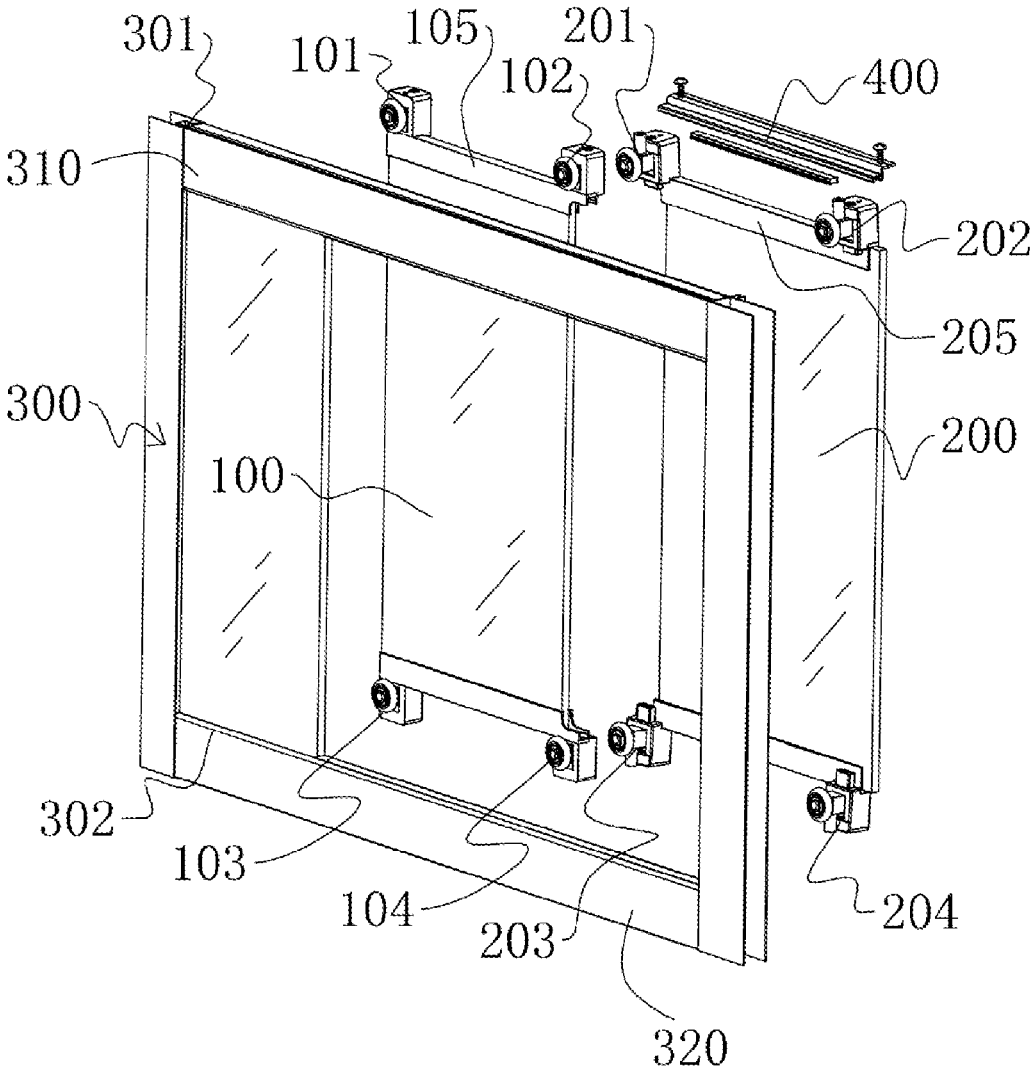
FIG. 1 shows an exploded view of an exemplified shower door of the present invention.

With reference to FIG. 1, a shower door assembly is shown which comprises a stationary frame 300 having a top frame 310 and a bottom frame 320. The top frame 310 has a top rail 301, and the bottom frame 320 has a bottom rail 302. The shower door assembly has a first movable glass door 100 having four roller units 101/102/103/104, with two of the four roller units 101/102 (also called first roller units) slidablely engaged with the top rail 301 of the top frame 310, and the other two 103/104 (also called second roller units) slidablely engaged with the bottom rail 302 of the bottom frame 320. Similarly, the shower door assembly has a second movable glass door 200 having four roller units 201/202/203/204, with two 201/202 (also called third roller units) in slidable connection with the top rail 301 and the other two 203/204 (also called fourth roller units) in slidable connection with the bottom rail 302.

When assembled, pulley 102 is located between roller units 201 and 202 and pulley 104 is located between roller units 203 and 204. The shower door assembly further comprises two pressing device 400, located on the third and fourth roller units respectively. The pressing device 400 is connected with the third/fourth roller units and in the meanwhile applies a friction force on one of the first/second roller units located between the third/fourth roller units, which will be described in detail herein after.

Figure 2:
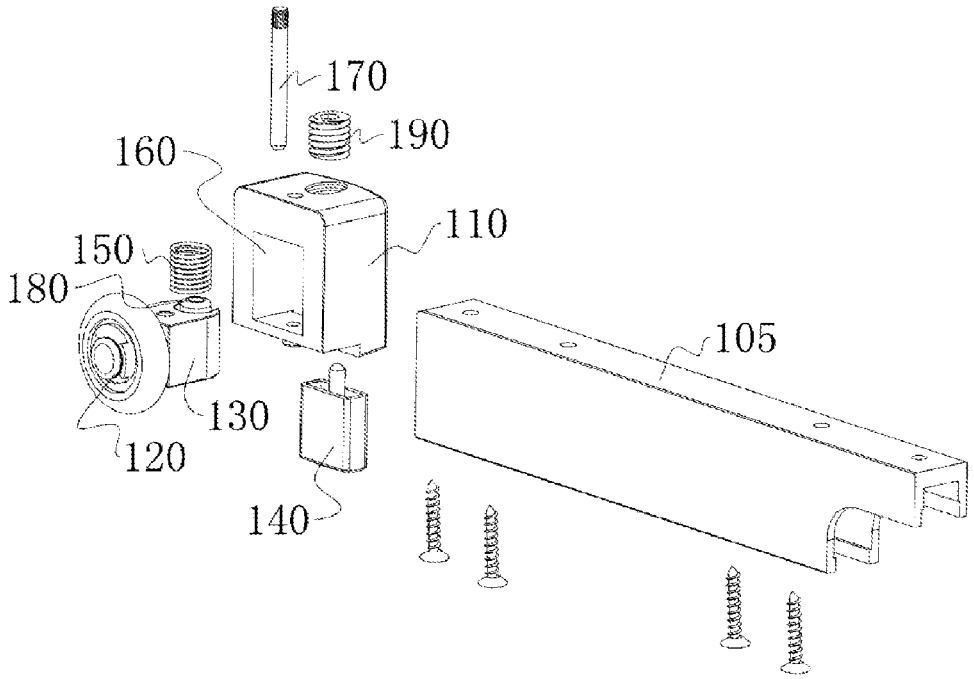
FIG. 2 shows an exemplified first/second pulley of the present invention.

As shown in FIG. 2, a first fixing frame 105 is provided at top and bottom of the first movable glass 100, onto which the first and second roller units are attached. Each of the first and second roller units 101/102/103/104 comprises a first roller seat 110 attached to the first fixing frame 105, a first roller bracket 130 having a first wheel 120, and a first pressing block 140 associated with the first roller bracket 130 and able to press the latter to move up and down.

The pulley further comprises a pin 170 penetrating from top to bottom of the seat 110. The first bracket 130 comprises a through hole for passing through of the pin 170 such that when assembled, the first bracket 130 can move up and down along the pin 170.

The first bracket 130 is receivable within a first cavity 160 of the first roller seat 110. The first wheel 120 is slidablely engaged with the top/bottom rail 301/302 of the stationary frame 300. In the present example, the rails are U-shape grooves and the wheels are able to roll in the groove, such that the movable glass doors are slidable along the top/bottom frames.

With reference to FIG. 2 again, a first elastic member 150 is provided in the pulley, which is placed in the cavity 160 in a position between the first roller bracket 130 and the first roller seat 110. When a force is applied on the pressing block 140 to push it towards the first elastic member 150, the first elastic member 150 will be compressed. On the other hand, when the force is withdrawn, the first elastic member 150 will return to its physically natural state. In the present invention, the first elastic member is a spring. The first bracket 130 is formed with a recess 180 for accommodating a part of the spring.

In FIG. 2, the first seat 110 further comprises a securing element 190. The securing element 190 is used to secure with the first bracket 130 by for example screwing, through a screw hole, against the first bracket 130, when the pulley is mounted to the frame.

Figure 3:
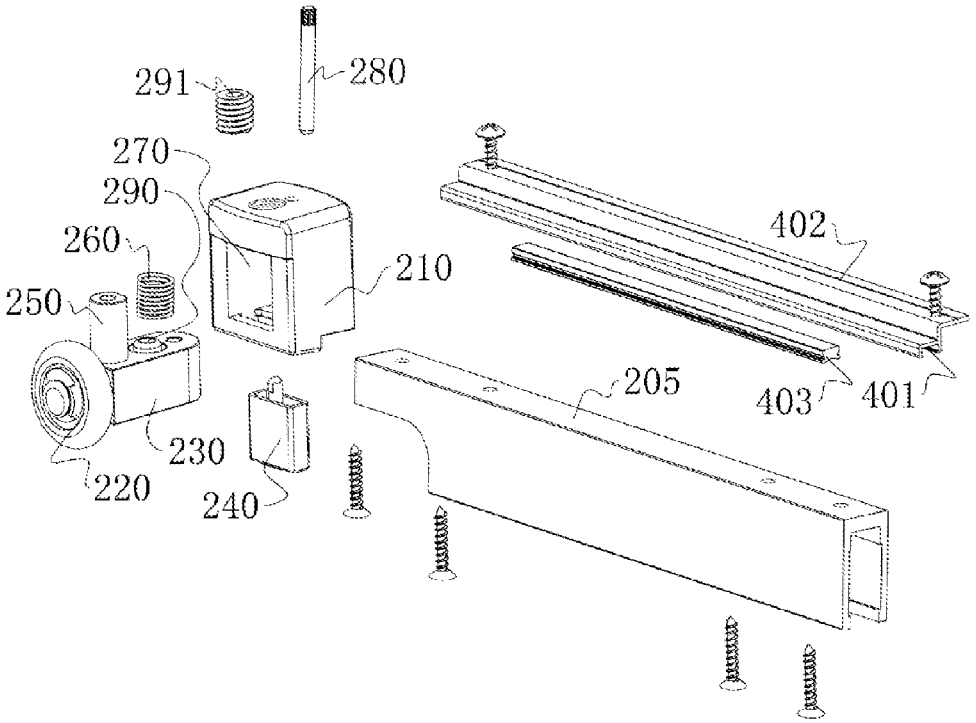
FIG. 3 shows an exemplified third/fourth pulley of the present invention.
Figure 4:
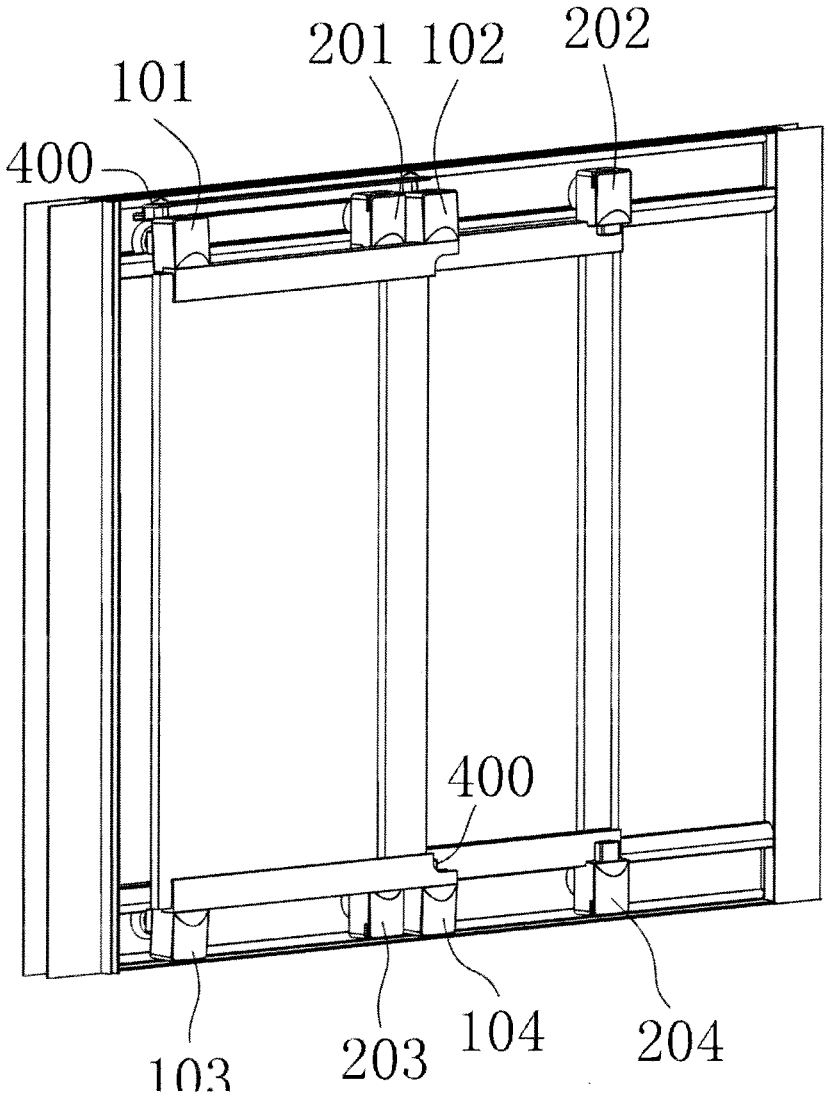
FIG. 4 shows an exemplified shower door of the present invention in assembled state.

Similarly, the third and fourth roller units are attached to the second movable glass door 200 through a second fixing frame 205. FIG. 3 shows a pulley according to either one of the third or fourth roller units. The pulley comprises a second roller seat 210 attached to the second fixing frame 205, a second roller bracket 230 having a second wheel 220, and a second pressing block 240 associated with the second roller bracket 230 and able to press the latter to move up and down.

The pulley further comprises a pin 280 penetrating from top to bottom of the seat 210. The second bracket 230 comprises a through hole for passing through of the pin 280 such that when assembled, the second bracket 230 can move up and down along the pin 280.

The second bracket 230 is receivable within a second cavity 270 of the second roller seat 210. The second wheel 220 is slidablely engaged with the top/bottom rail 301/302 of the stationary frame 300. In the present example, the rails are U-shape grooves and the wheels are able to roll in the groove, such that the movable glass doors are slidable along the top/bottom frames.

With reference to FIG. 3 again, the second roller bracket 230 further comprises a fixing plug 250 for engagement with the pressing device 400. Specifically, the pressing device 400 comprises a pressing bar 402 having a groove 401. The pressing bar 402 is connected with the fixing plug 250 of the second roller bracket 230 through, for example, screws. In the groove 401, an elongate rubber 403 is provided. The elongate rubber 403 is in contact with the wheel 120 of the first roller bracket 130.

In FIG. 3, a second elastic member 260 is provided in the pulley, which is placed in the cavity 270 in a position between the second roller bracket 230 and the second roller seat 210. When a force is applied on the pressing block 240 to push it towards the second elastic member 260, the second elastic member 260 will be compressed. On the other hand, when the force is withdrawn, the second elastic member 260 will return to its physically natural state. In the present invention, the first elastic member is a spring too. The second bracket 230 is formed with a recess 290 for accommodating a part of the spring.

According to the present example, the first and second fixing frames 105, 205 are frames made of Aluminum or alloys of Aluminum, which are identical with remaining parts of the stationary frame 300.

In FIG. 3, the second seat 210 further comprises a securing element 291. The securing element 291 is used to secure with the second bracket 230 by for example screwing, through a screw hole, against the second bracket 230, when the pulley is mounted to the frame.

During assembly, the first movable glass door 100 and the second movable glass door 200 are hang to the top frame 310 through the first roller units 101,102 and the third roller units 201~202. When hanging to the top frame 310, one of the first roller units, i.e., pulley 102 for the first movable glass door 100, is put between the roller units 201 and 202 for the second movable glass door 200. Then the first pressing block 140 of the second roller units 103, 104 is pressed. The first bracket 130 is forced to move downward and the first elastic member 150 is in turn compressed, so as to force the wheel 120 downward into the U-shape groove of the bottom frame 320. By withdrawn of the forces applied on the pressing block 140, the first elastic member 150 will tend to return to its original state, i.e., physically natural state, and thus push the first bracket 130 and in turn the first wheel 120 upwards, such that the first wheel 120 is engaged within the U-shape groove of the bottom frame 320. The first movable glass door 100 is thus mounted completely within the stationary frame 300.

Similar process applies to the second movable glass door 200. When assembled, the elongate rubber 403 of the pressing device 400 will be in contact with the wheel 120 of the first/second pulley so as to apply a friction force thereon. In this way, when the second glass door 200 is actuated to slide on the rails, the first glass door 100 will be brought to move to the same direction due to the friction force generated by the elongate rubber. When it is desired to open or close the movable doors in an opposite direction, it is only necessary to exchange the position of the first and second door.

It should be understood that various example embodiments have been described with reference to the accompanying drawings in which only some example embodiments are shown. The present invention, however, may be embodied in many alternate forms and should not be construed as limited to only the example embodiments set forth herein.

What is claimed is:

1. A shower door assembly comprising a top frame having a top rail and a bottom frame having a bottom rail;

a first movable glass door having at least two first roller units at a top end of the first movable glass door and at least two second roller units at a bottom end of the first movable glass door; and a second movable glass door having at least two third roller units at a top end of the second movable glass door and at least two fourth roller units at a bottom end of the second movable glass door;

wherein the first and third roller units are slidably engaged with the top frame, and the second and fourth roller units are slidably engaged with the bottom frame;

wherein at least one of the first roller units is located between the third roller units and pressed by a first pressing device provided on the third roller units, and as a result at least one of the second roller units is located between the fourth roller units and pressed by a second pressing device provided on the fourth roller units, wherein the first and third roller units are all provided on the top rail and the second and fourth roller units are all provided on the bottom rail, and wherein each of the first and second pressing devices comprises a pressing bar having a groove, and an elongate rubber received within the groove.

2. The shower door assembly of claim 1, wherein the first movable glass door is connected with the first and second roller units through a first fixing frame, and the second movable glass door is connected with the third and fourth roller units through a second fixing frame.

3. The shower door assembly of claim 1, wherein each of the first and second roller units comprises a roller seat connectable to the respective top or bottom frame, a roller bracket having a roller wheel and receivable in the roller seat, a first pressing block connected with the roller bracket and able to press the roller bracket to move, and a first elastic member provided between the roller bracket and the roller seat.

4. The shower door assembly of claim 1, wherein each of the third and fourth roller units comprises a roller seat connectable to the respective top or bottom frame, a roller bracket having a roller wheel and receivable in the roller seat, a second pressing block connected with the roller bracket and able to press the roller bracket to move, and a second elastic member provided between the roller bracket and the roller seat of each of the third and fourth roller units.

5. The shower door assembly of claim 3, wherein the roller bracket has a recess for accommodating at least a part of the first elastic member.

6. The shower door assembly of claim 4, wherein the roller bracket has a recess for accommodating at least a part of the first elastic member.

7. The shower door assembly of claim 3, wherein the roller seat has a securing element for securing against the roller bracket.

8. The shower door assembly of claim 4, wherein the roller seat has a securing element for securing against the roller bracket.

9. The shower door assembly of claim 1, wherein the elongate rubber seal is in contact with the at least one of the first roller units.

10. The shower door assembly of claim 9, wherein, when the second movable glass door is actuated to slide on the rails, the first movable glass door moves in a first direction due to friction force generated by the elongate rubber seal.

11. The shower door assembly of claim 10, wherein, when opening or closing the first and second movable glass doors in a second direction opposite the first direction, a position of the first and second movable glass doors is exchanged.

* * * * *